United States Patent [19]

Gould

[11] Patent Number: 5,016,886

[45] Date of Patent: May 21, 1991

[54] AUTOMATIC GOLF BALL TEE APPARATUS

[76] Inventor: Bobby J. Gould, Rte. 3, P.O. Box 224, Ada, Okla. 74820

[21] Appl. No.: 586,924

[22] Filed: Sep. 24, 1990

[51] Int. Cl.[5] ..... A63B 57/00

[52] U.S. Cl. ..... 273/201

[58] Field of Search ..... 273/201

[56] References Cited

U.S. PATENT DOCUMENTS

| | | | |
|---|---|---|---|
| 2,711,321 | 6/1955 | McGraw, Sr. | 273/201 |
| 3,294,402 | 12/1966 | Scott | 273/201 |
| 3,298,694 | 1/1967 | Turnau et al. | 273/201 |
| 3,378,263 | 4/1968 | Turnau et al. | 273/201 |
| 3,448,985 | 6/1969 | Scott | 273/201 |
| 4,741,537 | 5/1988 | Adam | 273/201 |
| 4,815,744 | 3/1989 | Diamonds | 273/201 |

FOREIGN PATENT DOCUMENTS

| | | | |
|---|---|---|---|
| 1110564 | 4/1968 | United Kingdom | 273/201 |

*Primary Examiner*—Theatrice Brown

*Attorney, Agent, or Firm*—Robert K. Rhea

[57] ABSTRACT

An apparatus for successively and automatically teeing up golf balls utilizing a source of vacuum as an operating media. A bank of golf balls are loaded on an inclined ramp in a reservoir positioned at one side of the tee position. Axially aligned, vertically disposed sleeves disposed below an opening in a horizontal base, slidably support an elongated tube having a golf ball supporting tubular tee on its upper end movable to a position above and below the plane of the base. A cylindrical wall diaphragm on the depending end of the elongated tube when evacuated, retracts the tube and tee for receiving a golf ball on the tee by golf balls successively rolling down an inclined ramp from a reservoir above the base to the top of the tee where a golf ball interrupts the air flow through the elongated tube reducing air pressure therein and contracting the diaphragm wall to elevate the tube to a teed-up golf ball driving position above the base.

8 Claims, 2 Drawing Sheets

AUTOMATIC GOLF BALL TEE APPARATUS

BACKGROUND OF THE INVENTION

1. Field of the Invention

This invention relates to golf ball driving practice and more particularly to an apparatus which automatically positions a golf ball in teed-up position substantially as quickly as the user drives a ball off the tee of this apparatus.

A basic requirement for improving golfing skill is repetitious use of various clubs, stances, and hand grips in practice.

It is desirable in such golf driving range practice that the ball be automatically teed-up in position for the golfer to again drive a ball following each driving stroke, thus, eliminating the necessity of releasing the grip on the golf club and manually placing a ball on a tee for the next and subsequent driving stroke.

This invention provides an apparatus which automatically and in succession places a golf ball on a tee in position for being driven.

2. Description of the Prior Art

The prior art discloses numerous golf tee positioning apparatus for use on driving ranges. Most of these devices are gravity operated or incorporate mechanical leverage systems including electrically operated cylindrical tee elevators substantially all requiring some movement or action on the part of a golfer, as by closing a switch or moving a lever by the golf club in hand or a foot operated trigger, in order to actuate the tee and ball elevating mechanism.

The most pertinent prior patent is believed to be U.S. Pat. No. 4,741,537 which discloses a spiral inclined ramp, gravity feeding a succession of balls to a tee position with a golfer operated trigger mechanism interposed in the path of ball movement, allowing one ball at a time to be positioned over the tee. The tee comprising a positive air pressure operated piston vertically moved in a cylinder in response to the ball being positioned over the cylinder.

This invention is distinctive over this patent by eliminating the necessity of any movement or change of stance by the golfer for successively addressing a teed-up ball following each driving stroke.

SUMMARY OF THE INVENTION

The golf ball supporting tee is formed by an elongated tube vertically slidable in a sleeve anchored below the surface of the earth for movement of the upper end portion of the tube through a tubular housing to project a selected distance above the surface of the earth.

The depending end portion of the movable tube is connected with a vacuum source and is surrounded by a cylindrical diaphragm which elevates or lowers the slidable tee forming tube in accordance with vacuum applied to or released from the movable tube.

A series of golf balls, gravity fed by an inclined ramp at one side of the tee forming tube position, singly feeds the balls, through a ball operated transfer tube, to the open top of the sliding tube.

The principal object of this invention is to automatically successively tee-up a golf ball in quick succession, following each driving stroke of a golfer practicing driving, which requires no action on the part of golfer other than driving a ball from the tee each time a ball is teed-up thereon.

Another object is to substantially reduce the time required for a golfer to drive a predetermined number of balls from a practice tee, thus substantially increasing the revenue of golf ball practice driving ranges.

DESCRIPTION OF THE PREFERRED EMBODIMENTS

Figure 1:
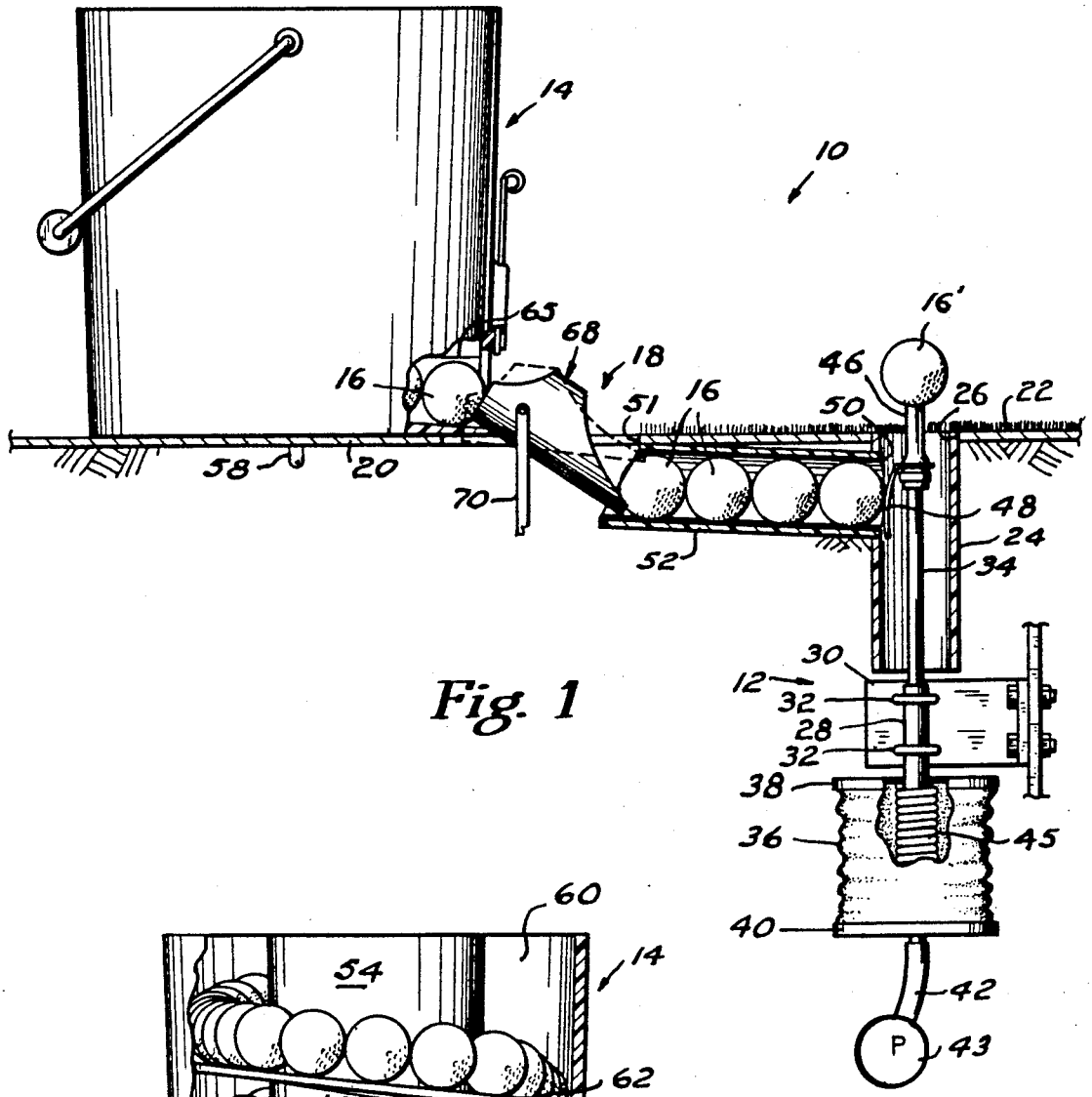
FIG. 1 is a vertical cross sectional view, partially in elevation illustrating the device in golf ball teed-up position.
Figure 2:
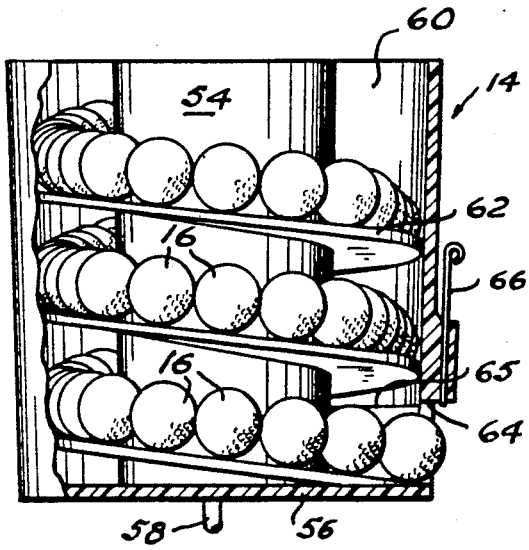
FIG. 2 is a vertical cross sectional view, partially in elevation, of the golf ball containing reservoir.

Like characters of reference designate like parts in those figures of the drawings in which they occur.

In the drawings:

The reference numeral 10 indicates the apparatus as a whole comprising a tee means 12 supplied with a plurality of golf balls 16 from a reservoir 14 by a feeder or transfer means 18.

The apparatus 10 further includes an apertured horizontal base plate 20 having an overlying layer of outdoor carpeting 22 or the like, simulating grass, in the area of the apparatus 10.

The tee means 12 comprises an open end sleeve housing 24 projecting axially downward from a first aperture or opening in the base 26. A guide sleeve 28 axially disposed below the sleeve housing 24 is vertically secured to a mounting plate 30 by a pair of U-clamps 32. An elongated tube 34 extends axially through and beyond both ends of the guide tube 28.

A cylindrical diaphragm 36 having closed ends 38 and 40 axially surrounds the depending end portion of the guide sleeve 28 and the depending end portion of the tube 34. The diaphragm end wall 38 is sealed with the periphery of the guide tube 28 and the diaphragm end wall 40 is sealed with the depending end portion of the tube 34 for the purposes presently explained.

The end portion of the tube 34 projecting downwardly beyond the diaphragm end plate 40 is axially connected with a flexible tube 42 in turn connected with a vacuum pump 43. The depending end portion of the tube 34, within the diaphragm, is provided with a wall aperture 44 (FIG. 3) for the reasons presently explained.

A helical spring 45 is interposed between the end walls 38 and 40 around the tube 34 and sleeve 28 within the diaphragm 36 to assist atmospheric pressure expanding the diaphragm to a relaxed position (FIG. 4), as hereinafter explained.

The opposite or top end of the tube 34 is axially connected with a short length of flexible tubing forming a golf ball tee 46 in axial communication with the tube 34.

The tee 46 supports, at its juncture with the rigid tube 34, a band spring 48 normally blocking a lateral ball passing opening 50 in the sleeve housing 24 communicating with one end of an inclined feeder sleeve 52 having its other end disposed adjacent a second base aperture 51 and forming a part of the feeder means 18 and normally containing a plurality, four, of the golf balls 16.

The ball reservoir 14 is an upwardly open bucket-like container in general configuration having a central sleeve 54 axially mounted on the inner surface of its bottom 56 resting upon the base plate 20. The reservoir is provided with indexing means comprising at least one depending guide prong 58 entering a cooperating hole formed in the base plate 20 for accurately repositioning the reservoir 14 each time a new supply of balls is provided for the tee means 12.

The sleeve 54 forms a one golf ball wide annulus 60 with the inner surface of the outer wall of the reservoir 14. A helical ramp 62 extends from the top to the bottom of the annulus 60 for supporting a series of the golf balls 16. The ramp incline is preferably 1.5 inches (3.81 cm) to 2 inches (5.08 cm) per foot (0.3 m) of length. The balls 16 roll by gravity down the ramp 62 and exit the reservoir through an opening 64 in its wall aligned with the branch sleeve 52 of the feeder or transfer means 18. A ramp/annulus stop or partition 65 prevents the balls 16 moving beyond the door opening 64 within the container. The reservoir opening 64 is manually opened and closed by vertical movement of a door 66 supported by the wall of the reservoir.

The feeder or ball transfer means 18 comprises, in addition to the branch sleeve 52, an unbalanced transfer tube 68 pivotally mounted at one end portion by a yoke 70 for vertical pivoting movement of the respective ends of the unbalanced tube 68 about the horizontal axis of the yoke. End portions of the transfer tube end surfaces respectively extend into the reservoir 14 through the door opening 64 and the end portion of the feeder sleeve 52, through the base opening 51, for singly transferring the golf balls 16 from the reservoir 14 to the feeder sleeve 52 as hereinafter explained.

OPERATION

Figure 3:
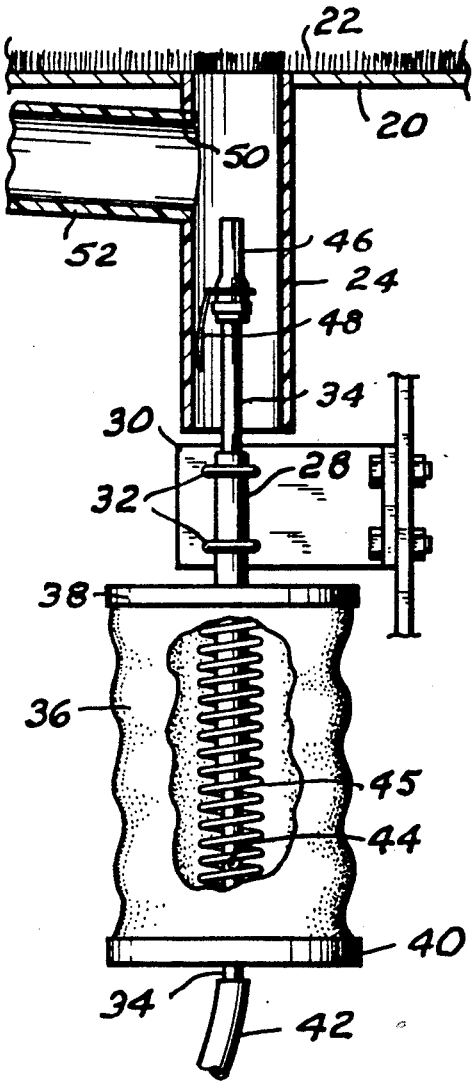
FIG. 3 is a fragmentary vertical cross sectional view, similar to FIG. 1, illustrating the tee tube in retracted ball receiving position; and, FIG. 4 is a view, similar to FIG. 3, illustrating the device when in an inoperative position.
Figure 4:
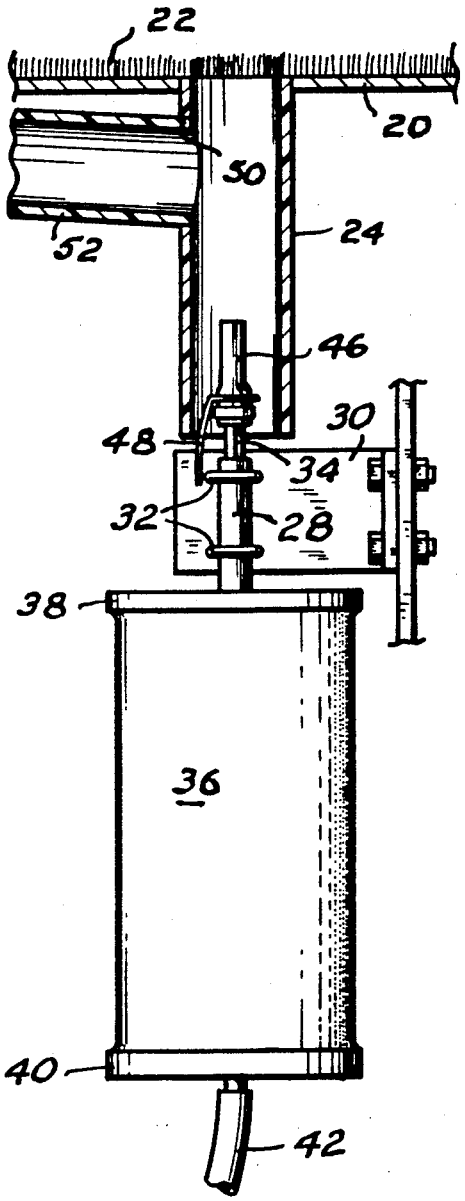

Assuming the device 10 is completely inoperative, that is the vacuum pump 43 is idle and the spring 45 has extended the diaphragm 36 to the position shown by FIG. 4, retracting the tube 34 to its fully downward position. The vacuum pump is started reducing ambient air pressure in the tube 42, wherein the vacuum drawn by the vacuum pump through the tube 34 and its aperture 44 partially collapses the diaphragm 36 against the action of the spring 45 to the position shown by FIG. 3. The top end surface of the flexible tee 46 is then disposed adjacent the lower limit of the sleeve housing ball opening 50.

The reservoir 14, containing the series of golf balls 16 with its door 66 in closed position is indexed on the base to insure alignment of the reservoir opening 64 with the ball transfer tube 68.

The door 66 is manually lifted so that the adjacent ball 16 will tilt the transfer tube 68 to its dotted line ball receiving position, as viewed in FIG. 1, so that a series of the balls successively roll to the feeder tube 52 by this pivoting action of the transfer tube 68.

The lead ball 16' enters the housing sleeve 24 and comes to rest on the upper open end of tee 46, thus stopping air entering the top end of the tube 34 through the tee by the vacuum pump action.

The pressure reduction or vacuum applied to the tube 34 further reduces the pressure in the diaphragm 36, through the tube wall opening 44, so that it collapses to its position of FIG. 1 which elevates the ball 16' to a teed-up position above the surface of the carpet 22 and in position to be struck by a golf club, not shown.

Simultaneously, the band spring 48 is disposed in ball stop relation at the end of the feeder sleeve 52, thus preventing the next successive ball or balls from entering the sleeve housing 24.

Similarly, the fourth ball, counting to the left as viewed in FIG. 1, in the feeder sleeve 52, maintains the transfer tube 68 adjacent end in downwardly inclined relation and its other end portion tilted upwardly to its solid line ball stop position preventing entry of a succeeding golf ball 16 into the transfer tube end portion adjacent the reservoir wall opening 64.

When the player drives the golf ball 16', its removal from the axial bore or opening of the tee 46 allows ambient air to enter the tube 34 and diaphragm 36, which by expanding, retracts the tee 46 into the sleeve housing to the position of FIG. 3 to receive the next succeeding golf ball, thus completing one cycle of operation.

Obviously the invention is susceptible to changes or alterations without defeating its practicability. Therefore, I do not wish to be confined to the preferred embodiment shown in the drawings and described herein.

I claim:

1. A teeing apparatus for golf ball driving practice, comprising:

a horizontal base having first and second apertures therein;

a sleeve housing axially disposed below the base first aperture;

ball elevator means vertically moveable through said sleeve housing and said first aperture from a lower ball loading position to an upper ball teed position, said ball elevator means including a guide sleeve rigidly mounted below said base in axial alignment with said base first aperture;

an elongated open end tube slidably received by said guide sleeve and having upper and lower end portions projecting beyond respective ends of said guide sleeve, said tube having a wall aperture intermediate said end portions;

a collapsible side wall cylindrical member having an upper end wall surrounding in sealing relation said upper end portion of said guide sleeve above said aperture and a lower end wall surrounding in sealing relation said lower end portion of said tube below said aperture for forming a vacuum chamber;

power means connected to said lower end of said tube whereby said chamber is caused to contract for raising said elevator means in response to the presence of a ball on the elevator means for causing expansion of said chamber and lowering said elevator means in response to the absence of a ball on said elevator means, ball reservoir means including an inclined ramp having a row of balls for gravity discharge in sequence toward said elevator means; and, feeder means for transferring a ball by gravity from said ball reservoir to said elevator means each time said elevator means is disposed in said loading position.

2. The apparatus according to claim 1 in which said means for causing expansion of said chamber is a:

spring means interposed between said vacuum chamber end walls for normally biasing said end walls in opposing directions and disposing the upper end portion of said tube in a lowered ball loading position; and, said power means is a vacuum pump operatively connected with said lower end portion of said tube for collapsing said vacuum chamber wall and sliding said tube upward relative to said guide sleeve and said base in response to a golf ball overlying and closing the upper end of said tube.

3. The apparatus according to claim 2 and further including:

a flexible golf ball tee having a central through opening axially mounted on the upper end of said tube.

4. The apparatus according to claim 3 in which said ball reservoir means includes:

an upwardly open upstanding circular side wall container having a bottom wall and having a ball discharge opening in its side wall adjacent its bottom wall;

a reservoir sleeve axially secured within said container for forming a golf ball receiving annulus between said sleeve and said container wall; and, an inclined helical ball ramp disposed in the annulus with its terminus cooperatively disposed adjacent the container wall opening.

5. The apparatus according to claim 4 in which the downward slope of said ramp from its upper end to its discharge end is 1.5 inches (3.81 cm) to 2 inches (5.08 cm) per foot (0.3 m) of its length.

6. The apparatus according to claim 4 in which the feeder means comprises:

a ball feeder sleeve below the base having a ball entry end cooperatively disposed adjacent the base second aperture and having its opposite end communicating with the upper end portion of said sleeve housing; and, ball transfer means including an unbalanced transfer tube longitudinally interposed between the container discharge opening and the ball entry end of said ball feeder sleeve for successively transferring golf balls by gravity, from said reservoir to said feeder sleeve.

7. The apparatus according to claim 6 in which the transfer tube is pivotally mounted adjacent one end on said base adjacent the container discharge opening for vertical pivoting movement of its respective ball receiving and ball discharge end portions about a horizontal axis, whereby a lowermost ball on said ramp pivots the ball receiving transfer tube adjacent end downwardly for passage of a ball into the transfer tube and the mass of a ball tilts the transfer tube discharge end portion downwardly as it moves by gravity beyond the transfer tube pivot point, lifting the ball receiving end of the transfer tube into stop position against a next ball on the discharge end of the ramp.

8. A teeing apparatus for golf ball driving practice, comprising:

a horizontal base having first and second apertures therein;

a sleeve housing axially disposed below the base first aperture;

ball elevator means vertically moveable through said sleeve housing and said first aperture from a lower ball loading position to an upper ball teed position;

said ball elevator means including a guide sleeve rigidly mounted below said base in axial alignment with said base first aperture;

an elongated open end tube slidably received by and projecting at its respective ends beyond the respective ends of said guide sleeve;

power means including an air pressure responsive diaphragm at the lower end of said tube for lowering and raising said elevator means in response to the absence or presence of a ball on the upper end of said tube, respectively;

ball reservoir means including an inclined ramp having a row of balls for gravity discharge in sequence toward said elevator means; and feeder means for transferring a ball by gravity from said ball reservoir to said elevator means each time said elevator means is disposed in loading position.

* * * * *